US007204451B2

(12) United States Patent
van de Camp

(10) Patent No.: US 7,204,451 B2
(45) Date of Patent: Apr. 17, 2007

(54) WINDING CORE AND ASSOCIATED METHOD

(75) Inventor: Wim van de Camp, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 127 days.

(21) Appl. No.: 10/786,949

(22) Filed: Feb. 25, 2004

(65) Prior Publication Data

US 2005/0184191 A1 Aug. 25, 2005

(51) Int. Cl.
*B65H 75/14* (2006.01)

(52) U.S. Cl. ..... 242/609; 242/610.4; 242/610.6; 242/613

(58) Field of Classification Search ..... 242/609, 242/610.4, 610.6, 611, 612, 613, 613.4, 613.5, 242/511.1, 542.4; 279/2.01, 2.02, 2.06, 2.1; 269/48.1; 428/217, 36.91
See application file for complete search history.

(56) References Cited

U.S. PATENT DOCUMENTS

| | | | | |
|---|---|---|---|---|
| 3,070,281 | A | 12/1962 | Durkin et al. | |
| 3,451,639 | A * | 6/1969 | Atwood et al. | 242/118.32 |
| 4,582,735 | A | 4/1986 | Smith | |
| 4,659,031 | A | 4/1987 | Saraisky | |
| 4,700,834 | A | 10/1987 | Martinez | |
| 4,824,705 | A * | 4/1989 | Persson et al. | 428/35.9 |
| 5,014,928 | A | 5/1991 | Gandy et al. | |
| 5,240,198 | A * | 8/1993 | Dorfel | 242/542.4 |
| 5,326,113 | A * | 7/1994 | Montalvo, III | 279/2.09 |
| 5,356,093 | A | 10/1994 | Kewin | |
| 5,505,395 | A | 4/1996 | Qiu et al. | |
| 5,820,069 | A * | 10/1998 | Segura Salvador et al. | 242/571.3 |
| 5,945,206 | A * | 8/1999 | Jogan et al. | 428/215 |
| 6,193,186 | B1 | 2/2001 | Kewin | |
| 6,540,174 | B1 | 4/2003 | Jarvinen | |
| 6,719,242 | B2 * | 4/2004 | Floyd et al. | 242/609.4 |
| 2002/0084378 | A1 | 7/2002 | Gerhart et al. | |
| 2003/0066925 | A1 | 4/2003 | Gerhardt et al. | |

FOREIGN PATENT DOCUMENTS

| | | |
|---|---|---|
| DE | 44 13 810 | 10/1994 |
| EP | 1 088 645 | 4/2001 |
| EP | 1 211 214 | 6/2002 |
| JP | 05085670 A * | 4/1993 |
| JP | 2002 179339 | 6/2002 |

OTHER PUBLICATIONS

Michael Fejer, Marko Ilomaki; New Challenges in Unwinding and their Impact on Core Requirements; Science and Technology; Das Papier 2003-T60; Jun. 27, 2002; pp. 33-34, 37-38.
PCT Notification of Transmittal of the International Search Report, PCT International Search Report mailed Jun. 13, 2005 for PCT/US2005/005834 (Filed Feb. 24, 2005).

* cited by examiner

*Primary Examiner*—William A. Rivera
*Assistant Examiner*—Sang Kim
(74) *Attorney, Agent, or Firm*—Alston & Bird LLP

(57) ABSTRACT

A winding core, a winding core assembly for winding web materials, and a method are provided. The winding core includes a hollow cylindrical core member having an inner surface, an outer surface, and first and second ends. A chuck-engaging layer is located on the inner surface of the core member, wherein the chuck-engaging layer is softer than the core member.

27 Claims, 3 Drawing Sheets

WINDING CORE AND ASSOCIATED METHOD

BACKGROUND OF THE INVENTION

1. Field of the Invention

The present invention relates to winding cores and, more particularly, to winding sheets of paper, film, and the like into large rolls and a method of winding such sheets onto a core.

2. Description of Related Art

Web materials such as polymer film, paper, nonwoven or woven textile, metal foil, sheet metal, and others, are used to manufacture a variety of products. The web materials are generally provided in the form of large rolls formed by winding the web material about a winding core. The core is generally paperboard, though it may be reinforced with a plastic outer shell or the like. The paperboard may be formed of high strength, high density paperboard plies. A roll of paper or the like wound onto the core typically has a weight above two tons and often exceeding five tons. Typical core sizes are an internal diameter of 3 in. (76.2 mm.) to 6 in. (152.0 mm.) or 150.4 mm. in Europe, and a length of about 100 to 140 in. To begin the winding process, a tail end of a web is attached to the winding core and the core is rotated about its axis to wind the web into a roll. The rolls are subsequently unwound during a printing or similar process.

Web converters such as printers or the like continually strive to increase productivity of converting processes by increasing the total amount of web throughput per unit time. To this end, there has been a continual push toward wider webs and higher web speeds, which lead to longer winding cores that must rotate at higher rotational speeds and must support heavier rolls of the wider web material. For instance, rotogravure printers are currently developing 4.32 m. wide printing presses for high-speed printing. Paper supply rolls for such presses would weigh in excess of 7 tons. Applications such as this place extreme demands on the stability of current winding cores. A potential solution to the problem is to increase core stiffness by increasing core diameter, but this would be undesirable if it meant that the cores would not be compatible with existing winding and unwinding machinery, as would be the case if the inside diameter of the core were increased.

During a winding or unwinding operation, a core is typically mounted on a rotating expandable chuck that is inserted into each end of the core and expanded to grip the inside of the core so that the core tends not to slip relative to the chuck as torque is applied therebetween. Typically, the rotation of the core is achieved by means of a drive coupled to one or both of the chucks, and the core is rotated to achieve web speeds of, for example, 15 to 16 m/s. The rolls of material are often subjected to substantial circumferential acceleration and deceleration by the winding machines. This, in turn, subjects the engaged ends of the paperboard roll to substantial torque forces. This often leads to some slippage of the chuck on the inside of the core. In an extreme situation, the slippage can lead to "chew-out" wherein the core is essentially destroyed by the chuck.

Aside from problems such as chew-out, the failure of the chuck to firmly grip the core can lead to other undesirable effects. In particular, it has been discovered that it can lead to a reduction in the "chuck factor" of the core, which is defined as the resonant frequency of the core when chucked, divided by the resonant frequency of the core when free. It is desirable for the chuck factor to be as high as possible without risking excessive vibration. The natural frequency of vibration of a core corresponds to that core's resonant frequency and may be calculated using the formula:

$$F = \frac{22.4 \times C_r}{2\pi} \times \left(\frac{E \times I}{m \times L^3}\right)^{\frac{1}{2}}$$

where F is the natural frequency of the core while chucked, $C_r$ is the relative chuck factor, E is the modulus of elasticity of the core along its length, I is the moment of inertia, m is the mass of the core, and L is the length of the core.

Efficient winding requires that the natural frequency of the chucked core be higher than the core rotational speed during winding and unwinding, where the natural frequency depends upon the above factors and the way it is supported by the chucks. A safety factor of 15 to 20% is typically taken into account, as there should be assurance that the maximum rotational frequency of the core while chucked will remain less than the natural frequency of the core. Current winding cores generally produce chuck factors of about 0.70 to 0.80, which limits the percent safety factor and winding speed of the core without risking excessive vibration.

Accordingly, a need exists for an improved core that provides better grip to prevent the chuck from slipping and possibly damaging the core during winding and unwinding. In addition, a need exists for a core that provides for an improved chuck factor.

BRIEF SUMMARY OF THE INVENTION

The invention addresses the above needs and achieves other advantages by providing a winding core with an improved gripping surface for a chuck and increased chuck factor. A chuck-engaging layer is disposed on a portion of the inner surface of the core member to provide a gripping surface to allow the chuck to engage the winding core in a manner less susceptible to slippage between the chuck and core. In addition, a combination of the chuck-engaging layer, a longer winding core, and a longer chuck can allow the winding core to wind and unwind more material at traditional winding speeds without increasing the winding core outer diameter substantially or sacrificing efficiency and safety.

In a first embodiment, a winding core includes a hollow cylindrical core member having an inner surface, an outer surface, and first and second ends. A chuck-engaging layer is affixed on the inner surface of the core member, wherein the chuck-engaging layer is softer than the core member.

In one variation, the core member comprises an inner layer defining the inner surface and an outer layer defining the outer surface. The inner layer comprises a paper-based material and the outer layer comprises glass fiber reinforced plastic. In addition, the chuck-engaging layer may comprise a polymeric material, such as polyurethane.

In additional variations, the length of the core member is about 4.32 meters. The outer diameter of the core member may be about 180 millimeters and the inner diameter may be about 154.4 millimeters. The chuck-engaging layer may be about 2 millimeters thickness bringing the diameter to 150.4 millimeters. Preferably, each chuck-engaging layer extends a portion of the length of the core member proximate to each of the first and second ends such that the layer does not extend the entire length of the core.

In yet another embodiment, a winding core assembly includes a hollow cylindrical core member having an inner surface, an outer surface, and first and second ends. A chuck-engaging layer is located on the inner surface of the core member, wherein the chuck-engaging layer is softer than the core member. Also, a chuck is operable to engage the chuck-engaging layer on the inside surface at the first end of the core member such that the chuck is coupled to the core member. The chuck may comprise a double row of expanding elements for engaging each of the chuck-engaging layers. Preferably, the assembly further comprises a second chuck operable to engage the chuck-engaging layer at the second end. Additionally, each chuck may be about 500 millimeters in length and have an active length of about 420 millimeters, wherein the chuck-engaging layer extends at least 420 millimeters in length proximate to the first and second ends such that each chuck is operable to engage each chuck-engaging layer.

The assembly may further include a motor coupled to one chuck, wherein the motor drives the chuck about an axis of rotation extending longitudinally through the core member. In one version, the winding core assembly achieves a chuck factor of at least 0.85.

The present invention also provides a method for winding web material. The method includes providing a hollow cylindrical core member having an inner surface, an outer surface, and first and second ends. The method also includes affixing a chuck-engaging layer to the inner surface of the core member, wherein the chuck-engaging layer is softer than the core member. The method further includes engaging a chuck to the chuck-engaging layer on the inside surface at the first end of the core member such that the chuck is coupled to the core member. The method lastly includes rotating the chuck about a longitudinal axis extending through the core member such that a web material is wound about the outer surface of the core member.

In variations of the method of the present invention, the chuck may rotate the core member at a chuck factor of at least 0.85. In addition, the affixing step may comprise coating the inner surface of the core member with a material such as polyurethane while the core member is rotating. Also, the affixing step preferably comprises affixing the chuck-engaging layer to localized regions of the core inner surface proximate to each of the first and second ends such that the chuck-engaging layer does not extend the entire length of the core member. A second chuck also preferably engages the chuck-engaging layer at the second end such that the second chuck is also coupled to the core member. The method may also comprise rotating the chuck such that the web material is unwound from the core member.

The winding core assembly of the present invention advantageously provides for an improved winding core having a chuck-engaging layer applied to its inner surface, which enables chucks on either end of the winding core to grip the chuck-engaging layer. The chuck-engaging layer is softer than the winding core material, such that the chuck can penetrate the chuck-engaging layer and create increased friction due to better contact with the winding core surface to prevent the chuck from slipping while the winding core is rotating.

The winding core assembly also can decrease the incidence of chew out, as the chucks are able to grip the chuck-engaging layer lining the inner surface of the winding core. In addition, the chuck factor of the winding core is increased, which correspondingly allows the safety factor to be increased. Increasing the safety factor ensures that the winding core may be rotated at higher than typical winding speeds without risking excessive vibration.

Winding cores in accordance with the present invention can be much longer than typical winding cores, which permits an increased amount of material to be wound. Also, the chucks preferably are longer to adequately grip the longer and heavier winding core. The combination of the chuck-engaging layer, longer winding core, and longer chucks allows the winding core to wind and unwind more material at current winding speeds without increasing the winding core outer diameter substantially or sacrificing efficiency.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
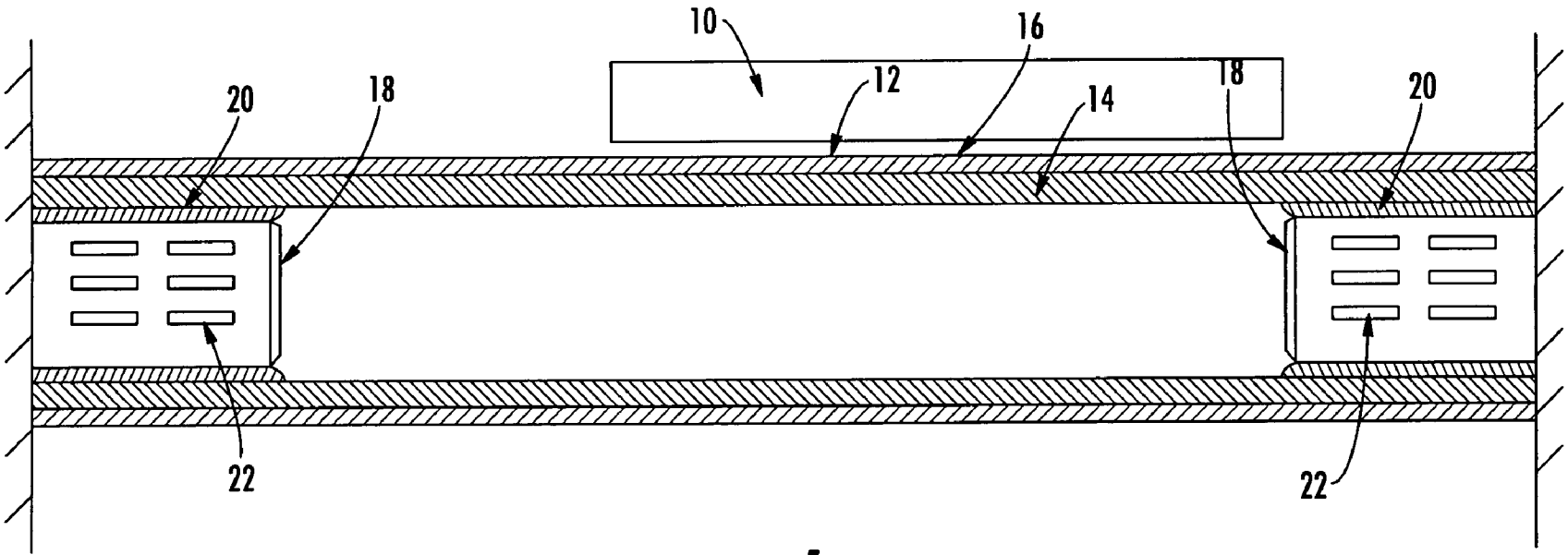
FIG. 1 is a cross-sectional side view of a winding core in accordance with one embodiment of the present invention, mounted on chucks, illustrating each chuck engaging a chuck-engaging layer on an inner surface of the core.

Referring now to the drawings and, in particular to FIG. 1, there is shown a winding core assembly 10. The term "winding core" is not meant to be limiting, and it is understood that the term winding core can be any core, reel, tube, cylinder, or the like used in a winding operation. Winding may be used to wind and unwind rolls of web materials such as polymer film, paper, nonwoven or woven textile, metal foil, sheet metal, and the like.

In a preferred embodiment, FIG. 1 illustrates that the winding core assembly 10 includes a winding core 12 having an inner shell 14 and an outer shell 16. A pair of chucks 18 are located at either end of the winding core 12 and have expandable elements 22 that engage a chuck-engaging layer 20 of the core. The chuck-engaging layer 20 is located at each end of the winding core 12, and is applied to improve the grip of the chucks 18, as will be explained more fully below.

The inner shell 14 is typically a paperboard material, although the inner shell could be any suitable material for the winding core 12. Generally, the paperboard material has a density of at least 0.5 g/cm$^3$ and even as great as 1.1 g/cm$^3$. It is preferred that the outer shell 16 is harder than the inner shell 14 and, thus, acts to reinforce the inner shell. Therefore, the outer shell 16 may be a plastic material such as glass fiber reinforced polyester, although it is understood that alternative reinforcing materials may be used for the outer shell. The glass fibers may be oriented lengthwise or circumferentially, or both, within the outer shell 16. In addition, it is understood that the winding core 12 could be a "homogeneous" tube wherein the entire core wall is formed of a single type of material, which is typical of most paperboard winding cores.

The inner shell 14 preferably has an outer diameter of about 177 mm., and the outer shell 16 preferably has a thickness of about 1.5 mm. Therefore, the total outer diameter of the winding core 12 is about 180 mm. The inner diameter of the winding core 12 is preferably about 154.4 mm. (without the chuck-engaging layer 20 applied). Winding cores 12 are typically standard diameters to accommodate uniform tooling, as mentioned above, but it is understood that the winding core may have various dimensions for both the inner and outer diameters of the winding core 12, as well as the inner 14 and outer 16 shell thicknesses. The length of the winding core 12 in one embodiment is about 4.32 m (170 in.), while typical winding core lengths 12 range from 100 to 140 in. Thus, the winding core 12 length according to the present invention can be longer than typical winding cores. However, it is understood that the winding core 12 could be various lengths depending on the specific web material being wound or other winding factors.

Figure 2:
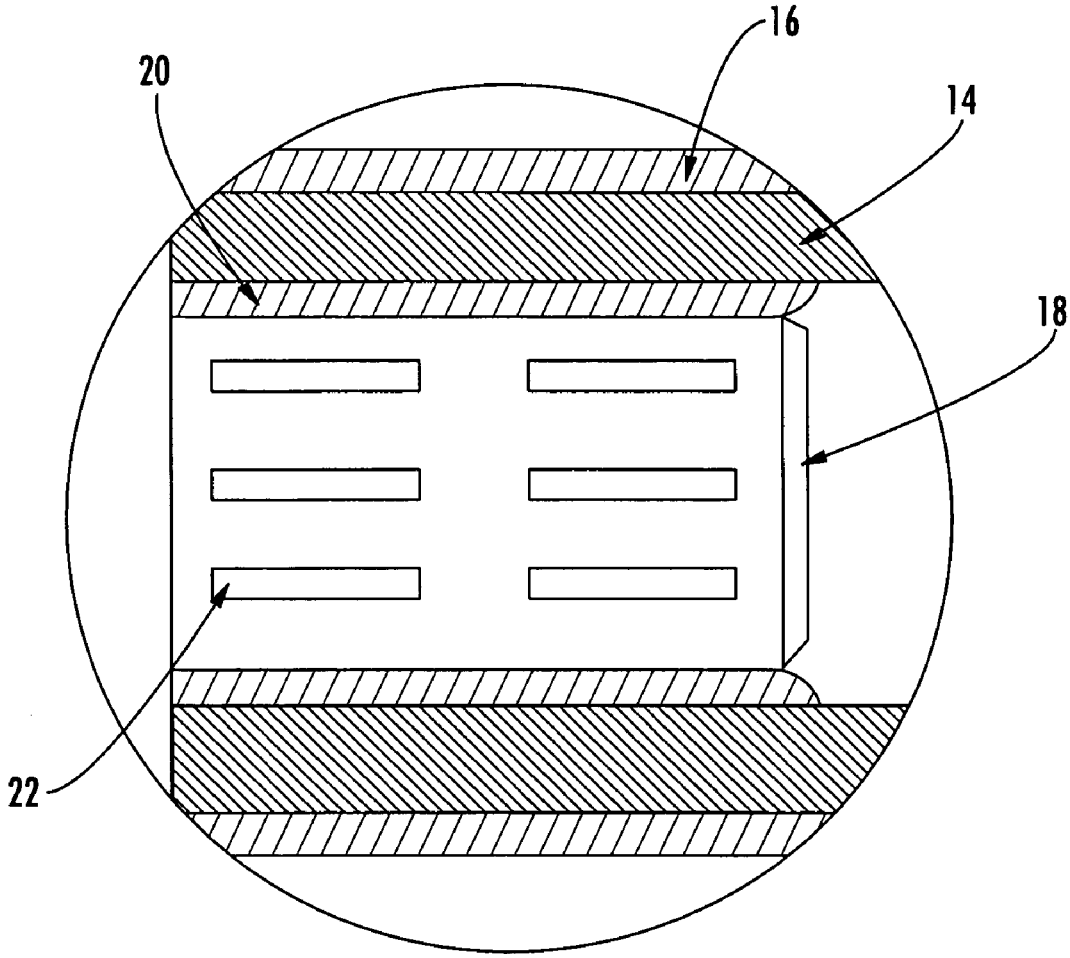
FIG. 2 is cross-sectional detail view of an individual chuck shown in FIG. 1, illustrating a double row of expandable elements that engage the chuck-engaging layer.
Figure 3:
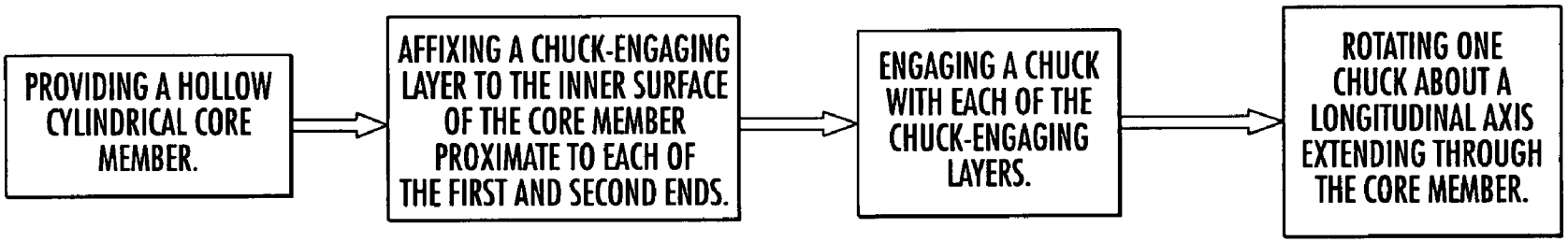
FIG. 3 is a flowchart of a method according to another embodiment of the present invention, illustrating a method of winding a web material onto the core.

The chuck 18 preferably includes a double row of expanding elements 22 as shown in FIG. 2. Each expandable element 22 is capable of expanding radially outward from the chuck 18, and both rows of expandable elements are disposed about the entire circumference of the chuck. Thus, the double row of expandable elements 22 is capable of engaging the inner surface of the winding core 12 circumferentially and uniformly. In a preferred embodiment where the winding core 12 is about 4.32 m. in length, a roll of paper wound on the winding core can approach a weight of 7 tons. The expandable element 22 on each chuck 18 located at the top of the winding core 12 thus supports the weight of the winding core in addition to the weight of the web material that is wound on the winding core at any given time. Consequently, the expandable elements 22 are capable of producing a substantial amount of force on the winding core 12 to both rotate and support the winding core.

The chucks 18 are hydraulically activated, so that once the expandable elements 22 are engaged with the chuck-engaging layer 20, the chucks apply a constant pressure to hold the winding core 12 in rotational engagement. Typically at least one chuck 18 is coupled to a motor or the like to drive the winding core 12 in rotation when winding the web material onto the winding core 12, while during unwinding at least one chuck is coupled to a brake that acts to stop the winding core from rotating. The winding core 12 is typically rotated at peripheral speeds of 15 m/s to 16 m/s, although various speeds could be employed with the present invention. In the illustrated embodiment, the chucks 18 have a length of about 500 mm.

Although the chucks 18 illustrated in FIGS. 1–2 include a double row of expandable elements 22, it is understood that the chucks could have a single row of expandable elements, or may alternatively not expand hydraulically but rather expand pneumatically or be cone pressed within the winding core 12, as known by those skilled in the art. Each of the expandable elements 22 may also be different sizes and shapes to accommodate different winding cores 12 or a specific winding application. In addition, the chucks 18 could be activated by torque as opposed to hydraulically. Different types and sizes of chucks 18 could also be implemented for different sized winding cores 12 or for different types of winding core materials. For example, the chuck 18 could be about 200 mm. as opposed to the longer 500 mm. chuck, where the longer chuck is more useful with longer windings cores 12.

The chuck-engaging layer 20 is applied to the inner shell 14 of the winding core 12 at each end. The chuck-engaging layer 20 preferably extends at least the length of the chuck 18, so that the chuck may engage the chuck-engaging layer along its entire length. The chuck-engaging layer 20 is preferably softer than the material comprising the inner 14 and outer 16 shells so that the chuck 18 may engage the chuck-engaging layer and create a "gripping" effect, as the friction between the chuck-engaging layer and the winding core 12 is increased. In one embodiment the chuck-engaging layer 20 is a polymeric material such as polyurethane, although it is understood that the chuck-engaging layer could be any number of polymeric, elastomeric, or like materials. The chuck-engaging layer is applied uniformly and circumferentially about the inner shell 14 to a thickness of about 2 mm., and the inner diameter of the winding core 12 is 154.4 mm. prior to applying the chuck-engaging layer, such that the inner diameter becomes 150.4 mm., which is a standard winding core diameter size in Europe. In addition, if the chuck 18 has an actual length of 500 mm. and an active length of about 420 mm., the chuck-engaging layer 20 is preferably at least 420 mm. in length along the winding core 12. This permits the full length of the expandable elements 22 of the chuck 18 to engage the chuck-engaging layer 20.

The chuck-engaging layer 20 may be various materials such as a polymeric material as mentioned previously, but could also be any material that is softer than the winding core 12 material. It is understood that the thickness of the chuck-engaging layer 20 could be modified to accommodate different sized chucks 18 or winding core 12 inner diameters. Typically, standard winding core 12 inner diameters are used to prevent the expense and inconvenience of changing tooling and logistics problems, but it is understood that the chuck-engaging layer 20 thickness could be adapted for any winding core inner diameter. For example, the chuck-engaging layer 20 could be applied to winding cores 12 at least as large as 16 in. in inner diameter. Similarly, the length of the chuck-engaging layer 20 could be any length to accommodate different sized chucks 18, and may even extend the entire length of the winding core 12 in other embodiments.

Therefore, the chuck-engaging layer 20 advantageously provides a surface that allows the chucks 18 to grip the winding core 12 to aid in preventing chew out, as well as increase the chuck factor to at least 0.70 and preferably at least 0.85. Testing has indicated that winding cores 12 having no reinforcing outer shell 16 may have a greater chuck factor than winding cores consisting of an inner shell 14 and a reinforcing outer shell 16. It is believed that the stiffness of the reinforcing outer shell 16 prevents the chucks 18 from "digging into" and properly engaging the inner surface of the winding core 12. Therefore, when the chuck-engaging layer 20 is applied to the inner surface of the winding core 12, the chucks 18 are better able to dig in and grip the inner surface of the core.

The chuck-engaging layer 20 can be applied with a spray gun to the inner surface of the winding core 12 while the winding core is rotated. The spray gun acts to direct the chuck-engaging layer 20 to a desired location within the winding core 12, after which the chuck-engaging layer cures and adheres to the inner surface of the winding core. The spray gun can direct a two-component mixture of isocyanide and polyol together under pressure onto the inner surface of the winding core 12. The mixture then cures within approximately 20 seconds to form the chuck-engaging layer 20.

In one embodiment, the winding core 12 is both rotated and supported by a pair of rollers positioned below the winding core while the spray gun is inserted within the winding core and the chuck-engaging layer 20 is applied. This produces a uniform layer of chuck-engaging layer 20, as the winding core 12 rotates so that the full inner circumference of the winding core is covered. The spray gun may be adjusted to modify the thickness and length of the chuck-engaging layer 20 applied to the inner surface of the winding core 12 to accommodate different sized chucks 18. The spray gun may be handheld, mounted to a bracket, or mounted to a fixture or robot such that the chuck-engaging layer 20 may be applied manually or automatically. An example of a spray gun according to one embodiment of the present invention is that manufactured by Gusmer Corporation.

It is understood that alternative techniques could be utilized to apply the chuck-engaging layer 20 to the inner surface of the winding core 12. For example, it is understood that various compositions could be used with the spray gun of the present invention to form the chuck-engaging layer 20, along with various curing times. In addition, the chuck-engaging layer 20 could be applied with an adhesive in instances where the chuck-engaging layer is not applied with a spray gun. In this regard, the chuck-engaging layer 20 could be a sheet of polymeric material that is adhesively attached or fastened to the inner surface of the wining core 12. Also, the chuck-engaging layer 20 could be applied to portions of the inner surface of the winding core 12 as opposed to the entire circumferential surface of the winding core. Thus, the chuck-engaging layer 20 could be applied such that the expandable elements 22 of the chuck 18 engage those portions where the chuck-engaging layer 20 is applied.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A winding core comprising:

a unitary cylindrical core member having an inner surface, an outer surface, and first and second ends, wherein a web material is capable of being wound on or unwound off of the outer surface of the core member; and a chuck-engaging layer affixed on the inner surface of the core member, wherein the chuck-engaging layer defines an innermost surface of at least a portion of the winding core, and wherein a hardness of the chuck-engaging layer is less than a hardness of the core member.

2. A winding core according to claim 1, wherein the core member comprises an inner layer defining the inner surface and an outer layer defining the outer surface.

3. A winding core according to claim 2, wherein the inner layer comprises a paper-based material and the outer layer comprises glass fiber reinforced plastic.

4. A winding core according to claim 1, wherein the chuck-engaging layer comprises a polymeric material.

5. A winding core according to claim 4, wherein the polymeric material of the chuck-engaging layer is polyurethane.

6. A winding core according to claim 1, wherein the length of the core member is about 4.32 meters.

7. A winding core according to claim 1, wherein the core member is about 180 millimeters in outer diameter.

8. A winding core according to claim 1, wherein the core member is about 154.4 millimeters in inner diameter.

9. A winding core according to claim 1, wherein the chuck-engaging layer is about 2 millimeters in thickness.

10. A winding core according to claim 1, wherein the chuck-engaging layer extends a portion of the length of core member proximate to each of the first and second ends such that the chuck-engaging layer does not extend the entire length of the core.

11. A winding core assembly according to claim 1, wherein the chuck is capable of rotating the core member at a chuck factor of at least 0.85.

12. The winding core according to claim 1, wherein at least an outermost layer of the core member is circumferentially continuous and cylindrical.

13. A winding core assembly comprising:

a winding core comprising:

a unitary cylindrical core member having an inner surface, an outer surface, and first and second ends, wherein a web material is capable of being wound on or unwound off of the outer surface of the core member; and a chuck-engaging layer secured to the inner surface of the core member, wherein the chuck-engaging layer defines an innermost surface of at least a portion of the winding core, and wherein a hardness of the chuck-engaging layer is less than a hardness of the core member; and a chuck operable to engage the chuck-engaging layer on the inside surface at the first end of the core member such that the chuck is coupled to the core member.

14. A winding core assembly according to claim 13, wherein the core member comprises an inner layer defining the inner surface and an outer layer defining the outer surface.

15. A winding core assembly according to claim 14, wherein the inner layer comprises a paper-based material and the outer layer comprises glass fiber reinforced plastic.

16. A winding core assembly according to claim 13, wherein the chuck-engaging layer comprises a polymeric material.

17. A winding core assembly according to claim 16, wherein the polymeric material of the chuck-engaging layer is polyurethane.

18. A winding core assembly according to claim 13, wherein the chuck comprises a double row of expanding elements for engaging the chuck-engaging layer.

19. A winding core assembly according to claim 13, further comprisinga second chuck operable to engage the chuck-engaging layer at the second end.

20. A winding core assembly according to claim 19, wherein each chuck is about 500 millimeters in length.

21. A winding core assembly according to claim 20, wherein the chuck-engaging layer extends at least 420 millimeters in length proximate to the first and second en such that each chuck is operable to engage each chuck-engaging layer.

22. A method of winding a web material comprising:

providing a hollow cylindrical core member having an inner surface, an outer surface, and first and second ends, wherein at least an outermost layer of the core member is circumferentially continuous and cylindrical;

affixing a chuck-engaging layer on the inner surface of the core member to form a winding core, wherein the chuck-engaging layer defines an innermost surface of at least a portion of the winding core, and wherein a hardness of the chuck-engaging layer is less than a hardness of the core member;

engaging a chuck to the chuck-engaging layer on the inside surface of the core member at the first end such that the chuck is coupled to the core member; and rotating the chuck about a longitudinal axis extending through the core member such that a web material is wound about the outer surface of the core member.

23. The method according to claim 22, wherein rotating the chuck rotates the core member at a chuck factor of at least 0.85.

24. The method according to claim 22, wherein the affixing step comprises coating the inner surface of the core member with a polyurethane while the core member is rotating.

25. The method according to claim 22, wherein the affixing step comprises affixing the chuck-engaging layer proximate to each of the first and second ends such that the chuck-engaging layer does not extend the entire length of the core member.

26. The method according to claim 25, further comprising engaging a second chuck to the chuck-engaging layer at the second end such that the second chuck is coupled to the core member.

27. The method according to claim 22, further comprising rotating the chuck such that the web material is unwound off of the core member.

* * * * *

UNITED STATES PATENT AND TRADEMARK OFFICE

CERTIFICATE OF CORRECTION

PATENT NO. : 7,204,451 B2
APPLICATION NO. : 10/786949
DATED : April 17, 2007
INVENTOR(S) : van de Camp It is certified that error appears in the above-identified patent and that said Letters Patent is hereby corrected as shown below:

Column 8,

Line 56, “comprisinga” should read --comprising a--;

Line 62, “en” should read --ends--.

Signed and Sealed this

Thirty-first Day of July, 2007

JON W. DUDAS
*Director of the United States Patent and Trademark Office*